United States Patent [19]

Schumacher et al.

[11] Patent Number: 5,075,594

[45] Date of Patent: Dec. 24, 1991

[54] PLASMA SWITCH WITH HOLLOW, THERMIONIC CATHODE

[75] Inventors: Robert W. Schumacher, Woodland Hills; Robert L. Poeschel, Thousand Oaks, both of Calif.

[73] Assignee: Hughes Aircraft Company, Los Angeles, Calif.

[21] Appl. No.: 406,673

[22] Filed: Sep. 13, 1989

[51] Int. Cl.[5] ..... H05H 1/24

[52] U.S. Cl. ..... 315/111.21; 315/111.81; 313/231.31; 250/423 R

[58] Field of Search ..... 315/111.01, 111.21, 315/111.81; 313/231.31; 250/423 R

[56] References Cited

U.S. PATENT DOCUMENTS

| | | | |
|---|---|---|---|
| 2,758,253 | 8/1956 | Lusk et al. | 315/339 |
| 3,065,372 | 11/1962 | Stutsman | 313/197 |
| 3,831,052 | 8/1974 | Knechtli | 313/187 |
| 4,297,615 | 10/1981 | Goebel et al. | 315/111.21 |
| 4,301,391 | 11/1981 | Seliger et al. | 315/111.21 X |
| 4,596,945 | 6/1986 | Schumacher et al. | 315/344 |
| 4,642,522 | 2/1987 | Harvey et al. | 315/111.81 X |
| 4,645,978 | 2/1987 | Harvey et al. | 315/111.81 |
| 4,733,137 | 3/1988 | Dunham | 315/111.21 X |
| 4,800,281 | 1/1989 | Williamson | 250/427 |
| 4,838,021 | 6/1989 | Beattie | 315/111.81 X |

OTHER PUBLICATIONS

IEEE Transactions on Electron Devices, vol. ED26, No. 10, Oct. 1979, New York, U.S., pp. 1444–1450, Fleischer, D. et al., "The Plasma-Heated Thyratron".

Severns, Rudolf P., "Modern Dc-To-Dc Switchmode Power Converter Circuits", Van Nostrand Reinhold Company, pp. 95–97.

Forman, Ralph, "Low-Voltage Arc and Breakdown Effects in Xenon-Filled Thermionic Diodes", Journal of Applied Physics, vol. 41, No. 12, Nov. 1970, pp. 4836–4840.

Martin, R. J. and Rowe, J. E., "Experimental Investigation of Low Voltage Arc in Noble Gases", Journal of Applied Physics, vol. 39, Nov. 9, Aug. 1968, pp. 4289–4298.

Schumacher, Robert W. and Harvey, Robin J., "Low-Pressure Plasma Opening Switches" Open Switches, Plenum Publishing Corporation, 1987, pp. 93–129.

*Primary Examiner*—Eugene R. LaRoche
*Assistant Examiner*—Do Hyun Yoo
*Attorney, Agent, or Firm*—V. D. Duraiswamy; W. K. Denson-Low

[57] ABSTRACT

A hollow cathode capable of self-heating by back ion bombardment to a thermionic emission temperature axially discharges therefrom an ionized plasma of an ambient gas such as xenon. Electrons are axially or radially extractable from the plasma by an anode. A voltage is applied to a keeper electrode disposed between the cathode and anode to sustain plasma discharge of the gas between the cathode and keeper electrode. A control electrode is disposed between the keeper electrode and the anode. Application of a positive voltage (relative to the cathode) to the control electrode causes the plasma discharge to extend from the cathode to the anode, thus closing the switch. Application of a negative control electrode voltage, or simply returning the control electrode to cathode potential, causes the plasma discharge to retract back to the area of the keeper electrode, thereby opening the switch.

28 Claims, 5 Drawing Sheets

PLASMA SWITCH WITH HOLLOW, THERMIONIC CATHODE

BACKGROUND OF THE INVENTION

1. Field of the Invention

The present invention generally relates to the field of plasma switches, and more specifically to a plasma switch combining a hollow, thermionically heated cathode with a control grid structure to enable switching (closing and opening) of high voltages and currents with a low voltage drop across the switch.

2. Description of the Related Art

Solid state switching devices including Gate-Turn-Off (GTO) thyristers and Integrated-Gate-Bipolar-Transistors (IGBT) are capable of fast-switching, low voltage drop, and cryogenic operation. Such devices have been heretofore used in high-power inverter/converter systems that convert high power from a low DC voltage to a high DC voltage. However, solid-state switches are low-voltage (<1 kV) devices, which either force the prime source to operate with a low voltage output or require the switch array to operate with many thyristers or IGBT's connected in series. Low-voltage operation requires high circulating current and causes high joule-heating losses in an associated transformer. Moreover, transformer coupling is poor because of the necessity for a high primary-to-secondary turns ratio when a high voltage output is required. Series operation of the IGBT's multiplies switch-power loss and requires additional snubbing circuits to force voltage sharing and to arrest voltage transients during off-switching. These transients are particularly severe when using high-turns-ratio transformers that have significant self-inductance. The snubbing circuits add mass to the inverter and consume additional power. Solid-state devices are also not sufficiently rugged or fault tolerant since they can fail catastrophically when subjected to a single over-current or over-voltage event. In addition, solid-state devices cannot operate in high-temperature and high-radiation environments, such as in space, in connection with a nuclear reactor power source, or in ground installations or mobile systems where high temperatures are encountered near a diesel or turbine motor. A discussion of these problems in inverter/converter systems of the type to which the present invention applies is found in a textbook entitled "MODERN DC-TO-DC SWITCHMODE POWER CONVERTER CIRCUITS", by R. P. Severns et al, Van Nostrand Reinhold Co, New York 1985, pp. 95 to 97.

A low pressure plasma opening switch has recently been developed which overcomes the major drawbacks of the conventional solid state switching elements discussed above. The switch is referred to as the CROSSATRON Modulator Switch (CROSSATRON is a trademark of the Hughes Aircraft Company, the assignee of the present invention). Details of this switch are provided in U.S. Pat. No. 4,596,945, issued June 24, 1986, to R. W. Schumacher et al, which is assigned to the Hughes Aircraft Company, and in a text edited by Guenther et al., Opening Switches, chapter entitled "Low-Pressure Plasma Opening Switches", Schumacher et al., pp. 93–129, Plenum Publishing Corp, 1987.

The CROSSATRON switch is a secondary-electron-emitter, cold cathode device which employs a controlled diffuse discharge to both close and open pulsedpower circuits at high speed and high repetition frequency, and enables operation at substantially increased voltage and current levels compared to the solid state switching devices. In addition, the CROSSATRON switch is rugged and fault-tolerant, and can be cooled cryogenically. However, the switch typically produces a forward voltage drop on the order of 500 V, making it unsuitable for certain applications.

Whereas the CROSSATRON switch utilizes cold cathode, crossed-field discharge for plasma formation, a hollow cathode plasma source such as disclosed in U.S. Pat. No. 4,800,281, issued Jan. 24, 1989, entitled "COMPACT PENNING-DISCHARGE PLASMA SOURCE", to W. S. Williamson, uses a thermionic cathode to form a plasma. A hollow cathode configuration eliminates the necessity of a magnetic field for plasma confinement, which is necessary to attain a sufficiently high level of back ion bombardment in a cold-cathode configuration, although such may optionally be provided as discussed in the patent. In a hollow cathode discharge, an electric potential, and optionally external heat, are applied to raise the cathode to thermionic discharge temperature and initiate a glow discharge. The hollow configuration of the cathode and the electron-reflecting cathode sheath formed thereon functions to increase the lifetime and path length of thermionically emitted electrons inside the cathode. This greatly increases the probability of multiple ionizing collisions of the electrons with gas molecules in the hollow cathode. This enables the plasma discharge to be sufficiently contained for purposes of sustaining the discharge without the need of any other external means. A characteristic of a hollow cathode plasma source is the very low forward voltage drop, which can be on the order of approximately 10 volts (when xenon gas is used), across the cathode and anode of the source.

Another example of a hollow cathode gas discharge device used as a source of electrons or ions is found in U.S. Pat. No. 3,831,052, entitled "HOLLOW CATHODE GAS DISCHARGE DEVICE", issued Aug. 20, 1974, to R. Knechtli. A preferred application of the device is as an electron source for a gas laser with high energy ionization.

SUMMARY OF THE INVENTION

A switch embodying the present invention is referred to as a HOLLOTRON switch (a trademark of the Hughes Aircraft Company), and is a gas-filled, grid-controlled rectifier capable of rapid current switching in both the on-switching and off-switching modes. The operation of the switch is somewhat similar to that of a thyratron. However, thyratrons are not capable of current interruption without use of resonant circuit elements to force a zero-current condition. The novel feature of the present HOLLOTRON switch is its ability to interrupt DC current at relatively high current density (2 A/cm$^2$), at a relatively high voltage (10 kV), with a low forward voltage drop on the order of 10–20 V. This is achieved by employing a thermionic hollow cathode discharge in xenon gas in a unique configuration with the current interruption capability of a CROSSATRON tube.

The present invention makes it possible to realize a more efficient and reliable inverter/converter design for high-voltage, high-power systems that must operate in high-temperature and/or high-radiation environments. The present plasma switch device makes it possible to modulate a higher-voltage DC input, thereby enabling operation of an associated transformer at lower input-current levels. This reduces joule-heating losses and simplifies the transformer design (lower turns ratio, smaller voltage transients).

The HOLLOTRON switch is most valuable in applications where light weight, reliability, and high efficiency are mandated. It may replace all of the solid state switches and associated protective circuitry in inverter/converter systems where the input voltage is higher than about 1 kV, thereby enabling the implementation of high-power (megawatt) inverter/converter systems with higher efficiency, lighter weight and higher reliability than systems using solid-state switches.

A plasma switch embodying the present invention includes a hollow cathode which axially discharges therefrom an ionized plasma of an ambient ionizable gas, preferably xenon. Electrons are axially or radially extractable from the plasma by an anode. In the radial embodiment, where the anode is annular, a voltage is applied to an annular keeper electrode disposed between the cathode and anode to sustain plasma discharge of the gas between the cathode and keeper electrode. An annular control electrode is disposed between the keeper electrode and the anode. Application of a transient positive voltage pulse to the control electrode causes the plasma discharge to extend from the cathode to the anode, thus closing the switch. During switch conduction, the control grid may float, with no drive current required to maintain conduction. Application of a negative voltage to the control electrode causes the plasma discharge to retract back to the area of the keeper electrode, thereby opening the switch.

In a preferred embodiment of the invention, the hollow cathode is formed of a material capable of self-heating by back ion bombardment to a thermionic emission temperature. The back-ion-bombardment is sufficient to initiate the plasma discharge at a very short time, on the order of microseconds to milliseconds.

The present plasma switch may be advantageously incorporated into a high power inverter/converter system, which utilizes the switch as a means for modulating a flow of direct current in the primary winding of a transformer at high frequency. The direct current may be provided by a fuel cell, alternator or other battery type device. Modulation of the current flow through the primary transformer winding causes a high voltage alternating current to flow in the secondary winding. This is then converted to direct current at a higher voltage by a rectifier arrangement.

Although a preferred application of the present plasma switch is in an inverter/converter system, it is not so limited, and may be advantageously used in any apparatus in which a high power, high-speed closing and opening switch is required.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
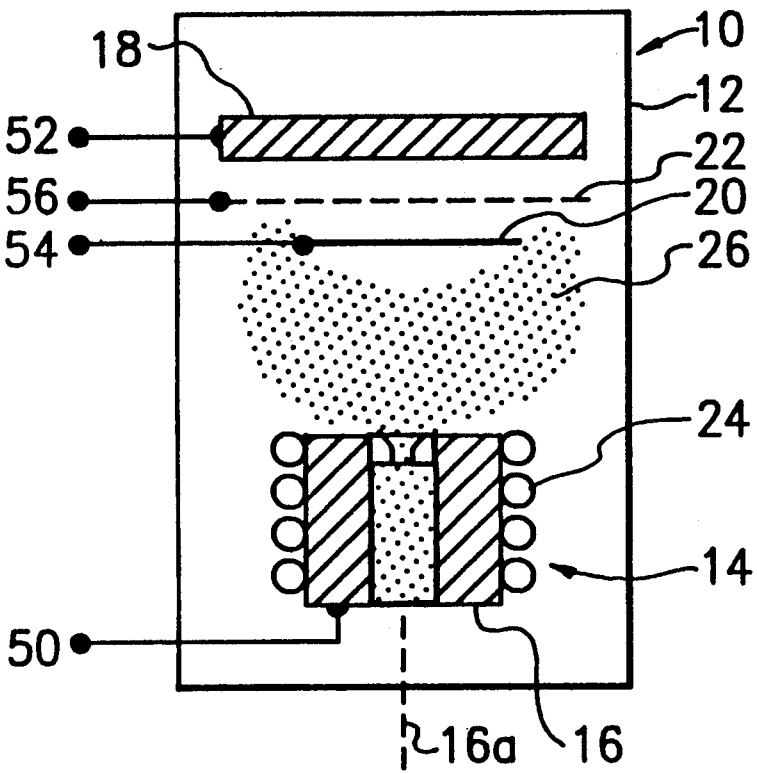
FIG. 1 is a simplified schematic diagram illustrating a linear embodiment of a plasma switch according to the present invention.

Referring now to FIG. 1 of the drawing, a plasma switch according to the present invention is generally designated as 10, and includes an enclosure 12 which contains an ionizable gas 14 which is, preferably, xenon. A hollow cathode 16 is provided inside the enclosure 12 in the form of a tube having an axis 16a which is oriented vertically as viewed in the drawing. A flat anode 18 extends perpendicular to, and is intersected by, the axis 16a of the cathode 16. A keeper/baffle electrode 20, which may be a plate, is disposed between the cathode 16 and anode 18. A control electrode 22, embodied by a mesh screen, is disposed between the keeper electrode 20 and the anode 18.

In operation, a voltage is applied to the keeper electrode 20 which is positive with respect to the cathode 16. If desired, an optional heater, symbolically illustrated as an electrical heater coil 24, may be provided to initially or continuously heat the cathode 16 to its thermionic emission temperature.

The voltage applied to the keeper electrode 20 causes the initiation of a low voltage glow discharge between the electrode 20 and cathode 16, resulting in ionization of the gas 14 and the formation of an ionized plasma 26. The voltage applied to the keeper electrode 20, as well as the spacings between the cathode 16, electrodes 20 and 22, and anode 18, and other variables, are selected such that, in the absence of a voltage applied to the control electrode 22, the plasma 26 will extend only to the vicinity of the keeper electrode 20. Thus, there is no electrical connection between the cathode 16 and anode 18, assuming that the voltage applied to the anode 18 is low enough to avoid Paschen discharge of the gas 14. It will be noted that the keeper electrode 20 also functions as a baffle to diffuse the plasma 26, and prevent it from impinging on the anode 18 in the form of a narrow jet which might damage the grid 22 and anode 18.

Application of a high enough positive voltage to the control electrode 22 will cause the plasma 26 to reversibly extend to the anode 18. Since the plasma 26 has very low electrical resistance, it will create an electrical connection between the cathode 16 and anode 18. Although the desired voltages and spacings will vary depending upon the particular device, specific design values are given for the embodiment of FIG. 5 discussed below. Similarly, the maximum ion current density at which current interruption is possible varies widely depending on the particular device configuration and scaling. Generally, the threshold may be predicted with reasonable accuracy by Child Langmuir theory as discussed in the above referenced patent to Schumacher.

In accordance with an important feature of the present invention, application of a negative voltage (relative to the cathode) to the control electrode 22 will cause the plasma 26 to retract away from the anode 18 back to the vicinity of the keeper electrode 20. Absence of the plasma 26 in the area between the keeper electrode 20 and anode 18 will interrupt the electrical connection between the cathode 16 and anode 18. Where the cathode 16 and anode 18 constitute switch contacts, the switch will be reversibly closed when positive voltage is applied to the control electrode 22, and opened when the negative voltage is applied.

As a general principle, the density of the plasma 26 must be low enough that it can be extended and retracted as described above in accordance with the voltage applied to the control electrode 22. In addition, the keeper and control electrodes 20 and 22 will generally be disposed much closer to the anode 18 than the cathode 16, to enable plasma interruption by the control electrode 22.

Preferably, the cathode 16 is made of a material having low thermal capacity, such as a thin refractory-metal foil, so that the heater coil 24 is not necessary. Suitable materials for the cathode 16 include tungsten, tantalum, and Rhenium, but are not so limited. The voltage applied to the keeper electrode 20 must have a relatively high value to initiate the plasma discharge, and may subsequently be reduced to a lower value to sustain the discharge. The keeper electrode voltage in conjunction with the material of the cathode 16 causes thermionic emission of electrons from the cathode 16, which are accelerated toward the keeper electrode 20. These electrons ionize the xenon gas by a multi-step, metastable-state ionization process which allows the discharge voltage to operate as low as 8 V. The keeper electrode voltage also provides the energy to accelerate xenon ions in the plasma discharge to heat the cathode. With this heating, the material of the cathode is elevated to thermionic emission temperature. The plasma forms a positive sheath on the surface of the cathode 16, which repels emitted electrons therefrom. This increases the path length of electrons in the interior of the cathode 16, resulting in multiple collisions of electrons with gas molecules, and the formation and sustenance of the plasma 26 through avalanche ionization. The voltage on the keeper electrode 20 further contributes to the sustenance of the plasma 26, and causes the same to extend out of the cathode 16 toward the anode 18.

Figure 2:
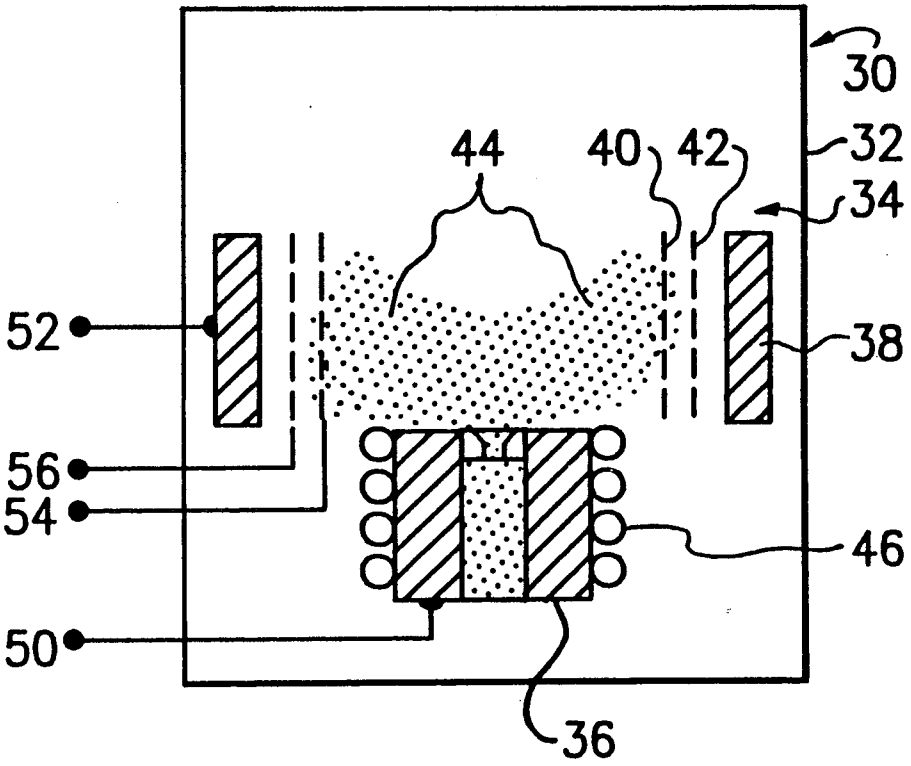
FIG. 2 is similar to FIG. 1, but illustrates a coaxial or radial embodiment of the plasma switch.

FIG. 2 illustrates a second embodiment of the present invention in the form of a plasma switch 30, which includes an enclosure 32 containing xenon gas 34. A hollow cathode 36 is provided in the same manner as in the switch 10. However, an anode 38 is embodied in generally annular form, coaxial with the axis of the cathode 36. An annular keeper electrode 40, and an annular control electrode 42, in the form of mesh screens, are disposed coaxially inside the anode 38, with the control electrode 42 being located between the keeper electrode 40 and the anode 38. Whereas the cathode 36 discharges an ionized plasma 44 in the axial direction (vertical as viewed in the drawing), the anode 38 extracts electrons from the plasma 44 in the radial (horizontal) direction. It has been determined that this arrangement enables improved diffusion of plasma without the addition of baffles as in the switch 10, while enabling enhanced voltage control of the plasma and increased current carrying capability. The ability to pass greater current through the switch 30 is due to the increased plasma area in the radial configuration, as opposed to high current concentration along the cathode axis in the linear configuration. If desired, a heater coil 46 may be provided to enhance thermionic emission from the cathode 36.

For the purposes of the invention, extraction of electrons in the radial direction means that the electrons are urged perpendicularly away their initial axial discharge direction. The actual direction of travel of the electrons has a radial component, but does not necessarily become completely perpendicular to the axis of the cathode.

Further illustrated in FIGS. 1 and 2 are contacts 50, 52, 54 and 56 which extend externally of the enclosures from the respective cathode, anode, keeper electrode, and control electrode. The contacts 50 and 52 constitute switch contacts which are opened and closed by the switching action described above.

Figure 3:
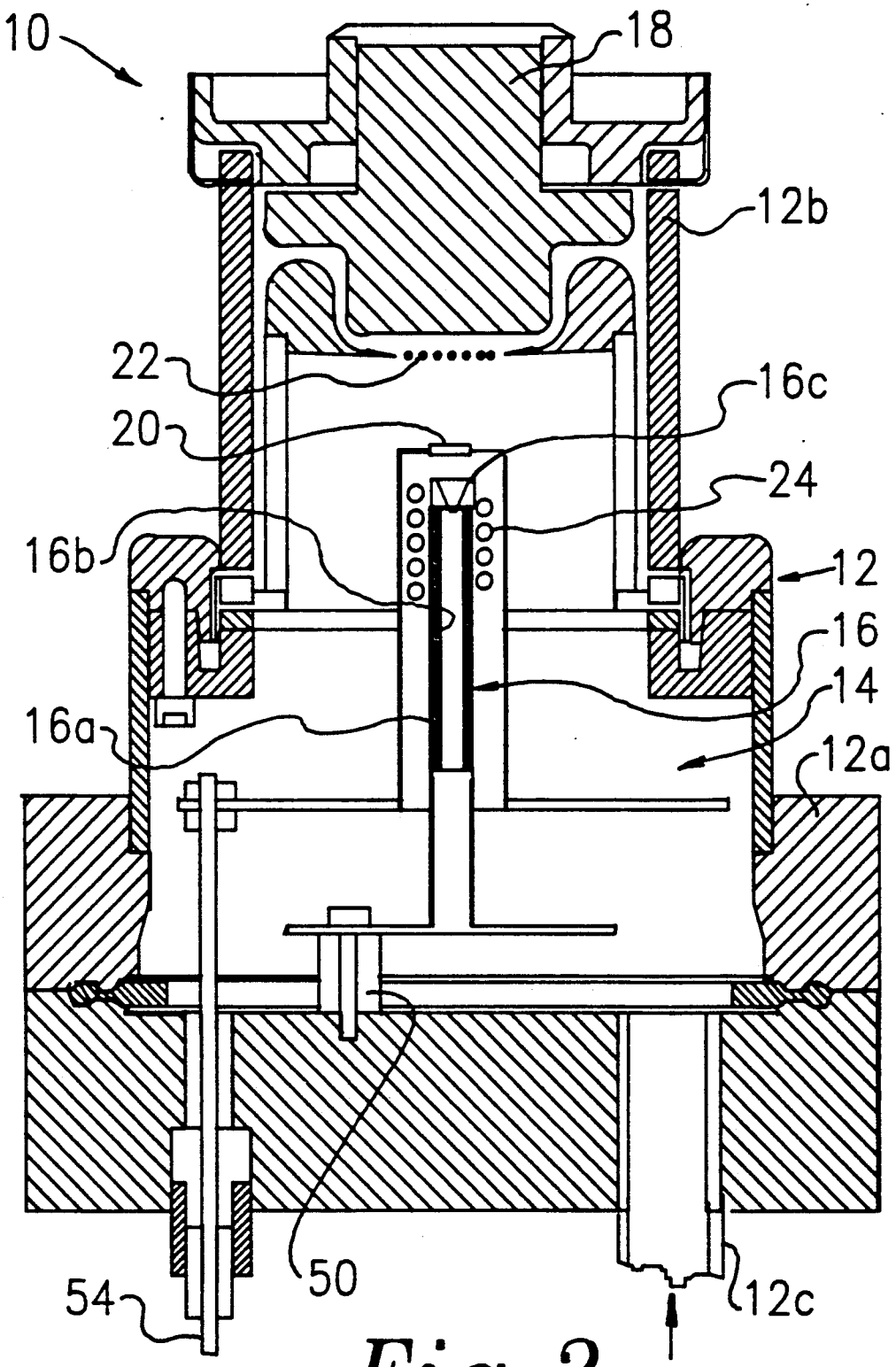
FIG. 3 is a vertical sectional view of the linear embodiment of the present plasma switch.

The linear embodiment of the invention is illustrated in greater detail in FIG. 3, with like elements being designated by the same reference numerals used in FIG. 1. The enclosure 12 includes a metal base 12*a*, and a tubular ceramic envelope 12*b*. An inlet tube 12*c* is provided to introduce xenon gas into the enclosure 12 from an external source (not shown).

The hollow cathode 16 includes a metal support tube 16*a*, which retains therein a tubular thermionic cathode insert 16*b*. The insert 16*b* is preferably made of porous tungsten impregnated with barium aluminate to increase the thermionic emission of electrons. A reduced diameter tip 16*c*, which defines a plasma discharge orifice, is fixed to the upper end of the support tube 16*a*. The tip 16*c* may be inert, or made of a thermionic emissive material.

Figure 4:
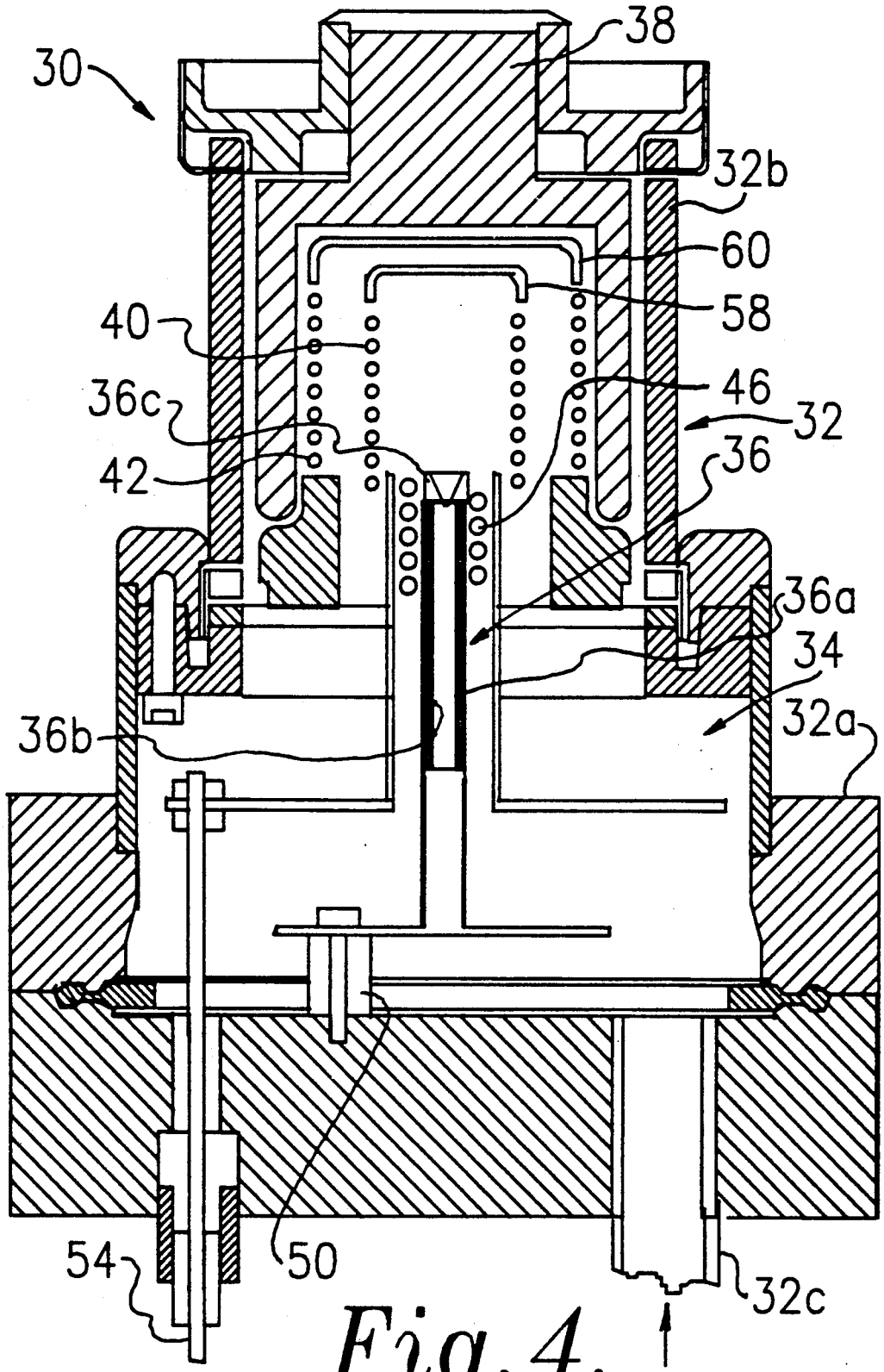
FIG. 4 is a vertical sectional view of the coaxial embodiment of the present plasma switch.

The coaxial embodiment of the invention is illustrated in greater detail in FIG. 4, with like elements being designated by the same reference numerals used in FIG. 2. The enclosure 32 includes a metal base 32*a*, and a tubular ceramic envelope 32*b*. An inlet tube 32*c* is provided to introduce xenon gas into the enclosure 32 from an external source (not shown).

The hollow cathode 36 includes a metal support tube 36*a*, which retains therein a tubular thermionic cathode insert 36*b*. The insert 36*b* is preferably made of porous tungsten impregnated with barium aluminate, as in the embodiment of FIGS. 1 and 3. A reduced diameter tip 36*c*, which defines a plasma discharge orifice, is fixed to the upper end of the support tube 36*a*. Further illustrated are generally disc-shaped support members 58 and 60 for fixedly retaining the upper ends of the keeper and control electrode mesh screens 40 and 42 respectively.

Current interruption was successfully achieved for the switch illustrated in FIGS. 1 and 3 at current densities of 2.5 A/cm$^2$, anode voltages as high as 5 kV, switching time of 300 ns, and a forward voltage drop during conduction in the 10 to 20 volt range. The switch 10 was operated at a periodic switching frequency (voltage applied to control electrode 22) of 20 kHz, and at a 50% duty cycle.

For an ambient xenon pressure of 120 mTorr, interruption of current (2.5 A/cm$^2$) at 5 kV anode voltage was achieved. At an ambient pressure of 460 mTorr, a 50% duty cycle was achieved, but only at lower current densities. As discussed above, the current limitation at higher gas pressure is believed to be caused by high current concentration on the hollow cathode axis. For this reason, radial extraction of electrons from the plasma as performed by the coaxial embodiment of the invention illustrated in FIGS. 2 and 4 is preferable in applications where high current densities are required.

Figure 5:
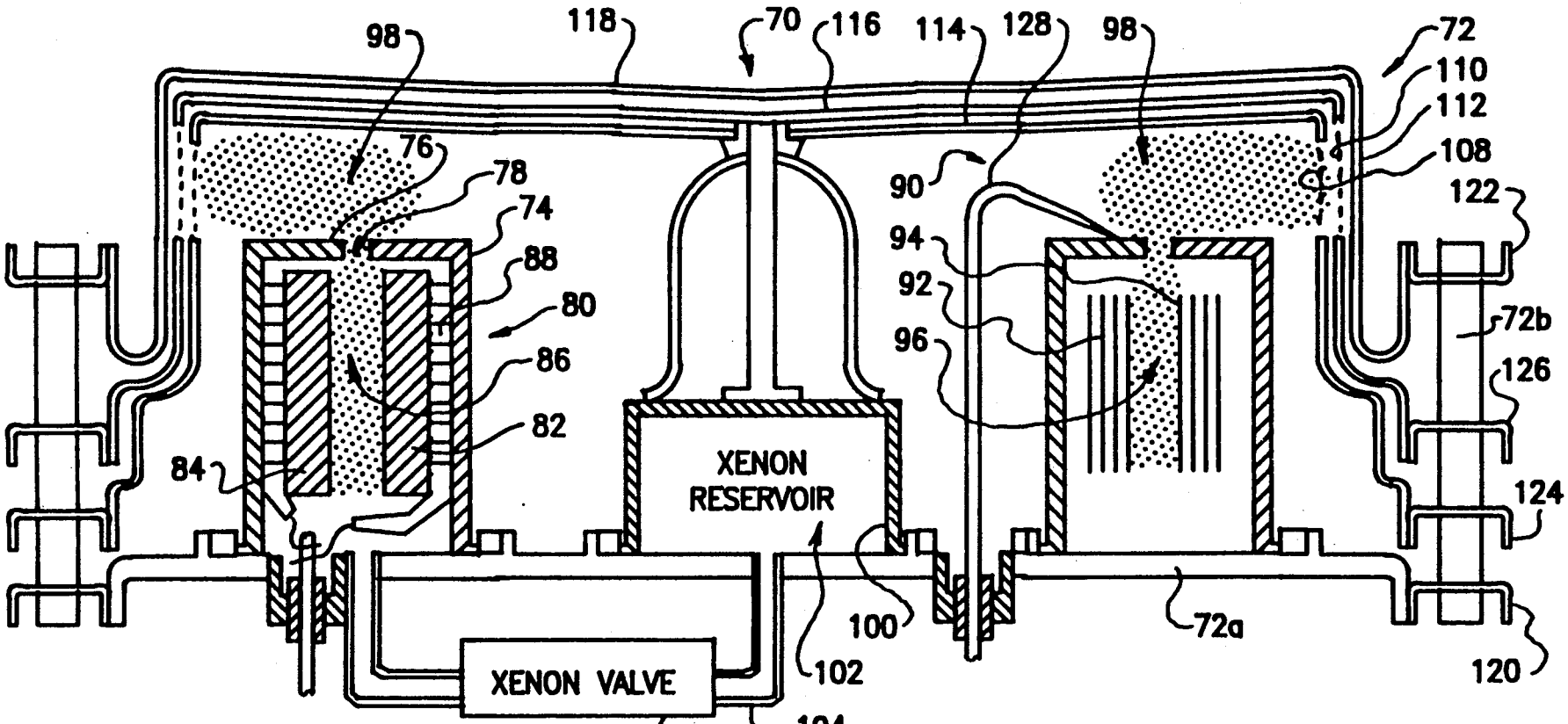
FIG. 5 is a vertical sectional view of a high power configuration of the present plasma switch.

FIG. 5 illustrates another embodiment of the HOLLOTRON switch which has been scaled to larger size for yet higher current operation. The switch of FIG. 5 is designated as 70, and generally has a coaxial or radial configuration as with the switch 30 of FIGS. 2 and 4.

The switch 70 differs from the switch 30 mainly in the configuration of the hollow cathode, and includes an enclosure 72 having a metal base 72*a* and an upstanding tubular ceramic insulator 72*b*. A support structure for the hollow cathode includes two upstanding, annular metal walls 74 and 76 which are bent toward each other at their upper ends to define a plasma discharge orifice 78.

Two alternative configurations of the hollow cathode are illustrated in FIG. 5. On the left side of the figure, a hollow cathode 80 includes two annular cathode insert sections 82 and 84 retained between the walls 74 and 76, which define an annular hollow space 86 therebetween. A heater coil 88 is also shown. The insert sections 82 and 84 are preferably made of porous tungsten, impregnated with aluminum carbonate.

The second alternative is shown on the right side of the figure, and includes a hollow cathode 90 having two annular cathode insert sections 92 and 94, which define an annular space 96 therebetween. The insert sections 92 and 94 are preferably made of layered foil rolls of tungsten, with a coating of barium carbonate on the layers of the rolls.

The hollow cathode 80 is used in applications where rapid startup is not required, but long operating lifetime is a priority. The heating coil 88 is optional, and may be omitted depending on the particular design criteria.

The cathode 90 has a lower thermal capacity than the cathode 80, and provides faster startup than the cathode 80 at the expense of shorter operating lifetime. The cathode 90 achieves sufficient self-heating by back ion bombardment to initiate and sustain plasma discharge in a very short time, without an external heater.

As with the embodiment of FIGS. 2 and 4, a plasma 98 is discharged axially by the cathode 80 or 90. However, the plasma 98 has an annular shape, and larger cross sectional area, than the linear plasma discharged by the cathodes 16 and 36. This enables substantially increased current as compared to the embodiments of FIGS. 1 to 4.

The plasma switch 70 further includes a reservoir 100 for containing a supply of xenon gas 102, a conduit 104 for conducting the gas to the interior of the cathode 80 or 90, and a valve 106 for metering the supply of gas. The switch 70 further includes an annular keeper electrode 108 in the form of a mesh screen or grid, a control electrode 110 shaped similarly to the electrode 108, and an annular anode 112 disposed coaxially outward of the electrodes 108 and 110. The electrodes 108 and 110 are retained at their upper ends by generally disc-shaped support plates 114 and 116 respectively. A similar support plate 118 is fixed to the upper end of the anode 112, and may constitute a portion of the enclosure 72. A cathode contact 120, anode contact 122, keeper electrode contact 124, and control electrode contact 126 are provided to facilitate connection of the respective elements to external means. In addition, a cold-starting electrode 128 may be provided to apply an initial starting voltage to the support wall 74.

In a practical configuration, the anode 112 may be approximately six inches in diameter. The spacing between the anode 112 and control electrode 110 may be approximately 0.5 mm, whereas the spacing between the keeper electrode 108 and control electrode 110 may be on the order of 2.0 mm. Means may be provided to maintain precise orientation and spacing between the anode 112 and electrodes 108 and 110, as well as to compensate for thermal expansion thereof.

The HOLLOTRON switch concept combines the capacity of a plasma cathode for conducting high current density at low voltage drop, with the current interruption capability obtained using electrode structures in CROSSATRON switches. The cylindrical cathode must be raised to thermionic emission temperature to obtain the low-forward voltage drop. Discharges of this type can be maintained at voltages well below the lowest excitation potential for the metastable states of the ambient gas, as shown in studies by R. Forman, "Low-Voltage Arc and Breakdown Effects in Xenon-Filled Thermionic Diodes", J. Appl. Phys., vol. 41, no. 12, pp. 4836–4840, (1970); and R. J. Martin et al, "Experimental Investigation of the Low-Voltage Arc in Noble Gases", J. Appl. Phys., vol. 39, no. 9, pp. 4289–4298 (1968). This property is an essential feature of the hollow-cathode plasma in the HOLLOTRON application, and is believed to be the consequence of metastable state excitation by the high energy tail of the Maxwellian thermionic electron distribution. Whenever the control grid is positive with respect to the cathode, the cathode plasma will expand into the anode plasma region and current will be conducted to the anode. Typically, as the cathode-to-anode current is increased from zero, the forward voltage drop decreases at first until a minimum value is reached, and then increases with increasing current.

The current carrying capacity of the device for a given forward voltage drop depends on the pressure of the ambient gas, the dimensions of the hollow cathode, the emission capability (temperature) of the thermionic emission surface, and the keeper electrode geometry. Ion thruster hollow cathodes like the one disclosed in the above referenced patent to Williamson can conduct current densities in excess of 1000 A/cm$^2$ through the cathode orifice at low forward voltage drop. In ion thruster cathodes, the gas flows continuously through the hollow cathode region, and current interruption or voltage stand-off are not considerations. In the HOLLOTRON application, the plasma density must be kept low enough to allow the control grid to extinguish the anode plasma and interrupt the cathode-to-anode current. On the basis of experience with CROSSATRON tubes, it is possible to interrupt current conduction using control grids at current densities up to 10 A/cm$^2$. Also, to maintain voltage standoff between the control grid and the anode with practical dimensions, the ambient pressure must be limited to about 1 Torr to avoid Paschen breakdown.

The hollow cathode may be made of tungsten, or any suitable refractory or high temperature metal capable of thermionic emission. The gas may be a noble gas, preferably xenon, or any other gas which is ionizable within the desired parameters. The voltage applied to the control electrode need only be on the order of +10 V to close the switch. The control electrode voltage may be reduced to the same value as the cathode, or reduced to a negative value on the order of −10 V to open the switch. Typically, the voltage applied to the keeper electrode will be approximately 50 to 100 V to initiate the plasma discharge, and then be reduced to 10 to 15 V to sustain the discharge. The xenon pressure in the vicinity of the cathode may be typically on the order of 50 to 500 mTorr, with the preferred value being approximately 200 mTorr. The HOLLOTRON switch is capable of holding off an anode voltage of at least 10 kV, at an average current of 100 A, with a forward voltage drop of less than 20 V, operating at a switching frequency of 20 kHz. The switching time is on the order of 300 to 500 ns.

Figure 6:
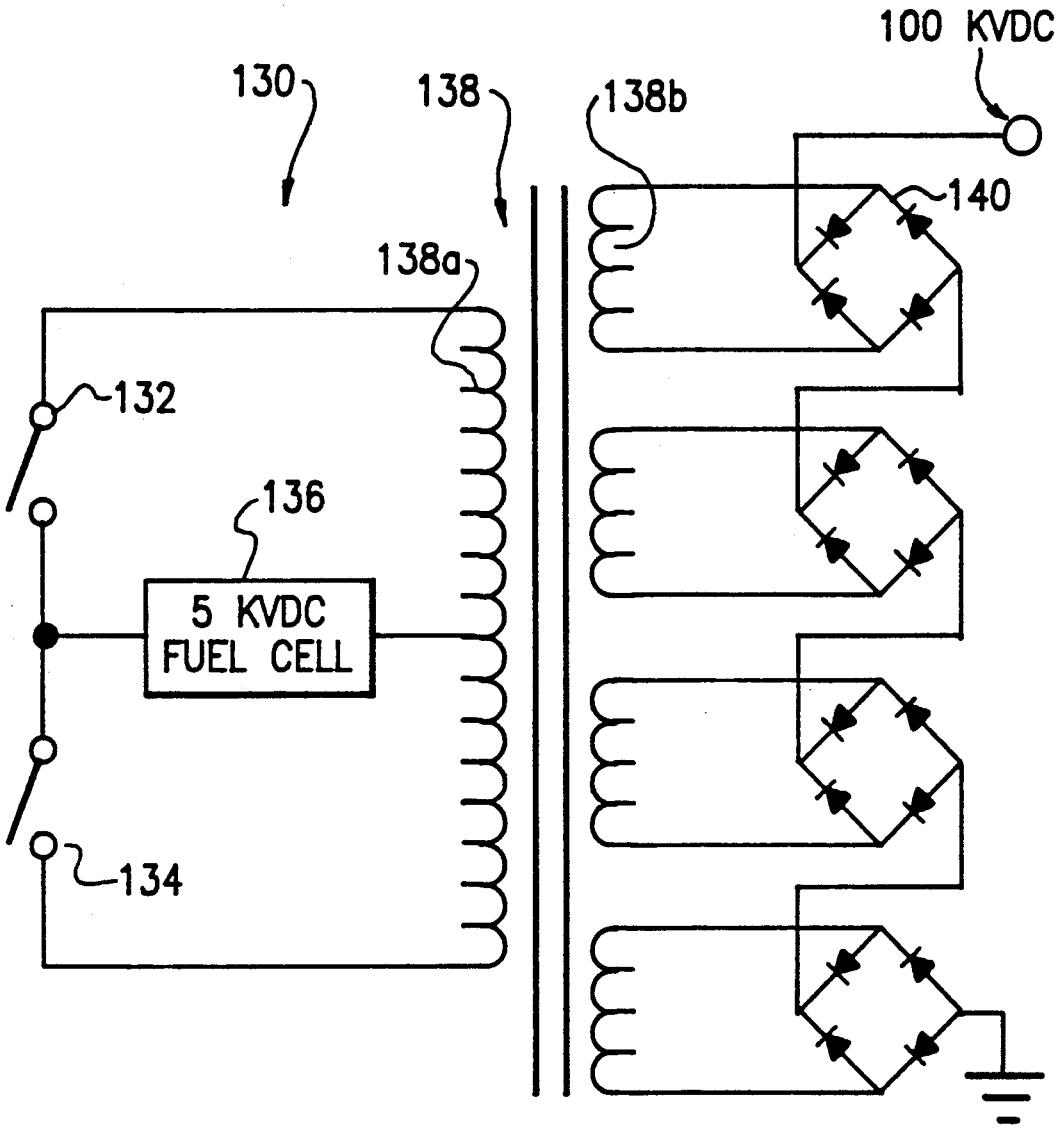
FIG. 6 is a schematic diagram of an inverter/converter system including a plasma switch embodying the present invention.

FIG. 6 illustrates an inverter/converter unit 130 embodying the present invention, including two HOLLOTRON plasma switches 132 and 134 of any of the types described above. The unit 130 further includes a fuel cell or other direct current power source 136, for typically producing a DC voltage of 5 kV at a current of 220 A. One terminal of the cell 136 is connected to a center tap of a primary winding 138*a* of a transformer 138. The ends of the primary winding 138*a* are connected through the plasma switches 132 and 134 respectively to the other terminal of the cell 136. The transformer 138 is illustrated as having four secondary windings 138*b*. A full wave bridge rectifier 140 is connected across each secondary winding 138*b*. The outputs of the bridge rectifiers 140 are stacked on each other, such that the output voltage across the stack is the sum of the individual output voltages across the secondary windings 138*b*. A periodic square wave signal at typically 20 kHz is applied to the control electrodes of the switches 132 and 134 in out of phase relation, such that one switch will be closed while the other switch is open, and vice-versa. This causes periodic square-wave current flow in the primary winding 138*a*, which enables an AC square wave voltage to be induced in the secondary windings 138*b*.

In a practical application, the turns ratio of the transformer 138 may be selected so that a voltage drop of 10 kV (from the fuel cell 136) across the primary winding 138*a* will cause 25 kV to be induced in each secondary winding 138*b*. The AC voltage in the secondary windings 138*b* will be converted to a DC voltage of 25 kV by each bridge rectifier 140, thus producing a DC voltage output across the stack of 100 kV at 10A.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

We claim:

1. A plasma switch comprising:

an enclosure for containing an ionizable gas;

thermionic hollow cathode means, and anode means, disposed inside the enclosure;

the hollow cathode means axially discharging therefrom an ionized plasma of the gas;

the anode means being disposed to extract electrons from the plasma discharged from the hollow cathode means;

keeper electrode means disposed between the hollow cathode means and the anode means for sustaining plasma discharge of the gas between the hollow cathode means and the keeper electrode means in response to a first voltage applied to the keeper electrode means; and control electrode means disposed between the keeper electrode means and the anode means for causing the plasma to extend from the hollow cathode means to the anode means in response to a second voltage applied to the control electrode means, the second voltage being positive relative to the cathode means thereby electrically connecting the hollow cathode means and anode means with a low forward voltage drop, the pressure of the ionizable gas being low enough to maintain voltage standoff between the control electrode means and the anode means;

the hollow cathode means, anode means, keeper electrode means, and control electrode means being configured such that the plasma will extend from the hollow cathode means substantially only to the keeper electrode means when the second voltage on the control electrode is changed to be non-positive relative to the cathode means, thereby interrupting the electrical connection between the anode means and the hollow cathode means.

2. A plasma switch as in claim 1, in which the anode means is disposed along the axis of the hollow cathode means.

3. A plasma switch as in claim 2, in which the keeper electrode means comprises a plate disposed along the axis of the hollow cathode means.

4. A plasma switch as in claim 1, in which the ionizable gas is xenon.

5. A plasma switch as in claim 1, in which the first voltage is positive relative to the hollow cathode means.

6. A plasma switch as in claim 1, in which the hollow cathode means comprises a material selected from the group consisting tungsten, tantalum, and Rhenium.

7. A plasma switch as in claim 6, in which the material is porous.

8. A plasma switch as in claim 7, in which the porous material comprises tungsten impregnated with aluminum carbonate.

9. A plasma switch as in claim 6, in which the material is in the form of at least partially concentric layers of foil.

10. A plasma switch as in claim 9, in which the layers are coated with barium carbonate.

11. A plasma switch as in claim 1, in which the hollow cathode means is formed with a discharge orifice having a diameter which is reduced relative to the remainder of the cathode.

12. A plasma switch as in claim 1, further comprising heater means for heating the hollow cathode means to thermionic emission.

13. A plasma switch as in claim 1, further comprising starter means for temporarily applying a voltage to the keeper electrode means which is sufficiently high to initiate plasma discharge of the gas between the hollow cathode means and the keeper electrode means.

14. A plasma switch as in claim 1, in which the hollow cathode means comprises a material capable of self-heating by back ion bombardment to a thermionic emission temperature sufficient to initiate and sustain said plasma discharge.

15. A plasma switch as in claim 14, in which the material is selected from the group consisting of tungsten, tantalum, and Rhenium, and is in the form of a rolled foil of at least partially concentric layers coated with barium carbonate.

16. A plasma switch comprising:

an enclosure for containing an ionizable gas;

hollow cathode means, and anode means, disposed inside the enclosure;

the hollow cathode means axially discharging therefrom an ionized plasma of the gas;

the anode means being disposed to radially extract electrons from the plasma discharged from the hollow cathode means;

keeper electrode means disposed between the hollow cathode means and the anode means for sustaining plasma discharge of the gas between the hollow cathode means and the keeper electrode means in response to a first voltage applied to the keeper electrode means; and control electrode means disposed between the keeper electrode means and the anode means for causing the plasma to extend from the hollow cathode means to the anode means in response to a second voltage applied to the control electrode means, thereby electrically connecting the hollow cathode means and anode means;

the hollow cathode means, anode means, keeper electrode means, and control electrode means being configured such that the plasma will extend from the hollow cathode means substantially only to the keeper electrode means when the second voltage on the control electrode is changed to be non-positive relative to the cathode means, thereby interrupting the electrical connection between the anode means and the hollow cathode means.

17. A plasma switch as in claim 16, in which the keeper electrode means, control electrode means, and anode means are generally annular and are disposed coaxially about the axis of the hollow cathode means.

18. A plasma switch as in claim 16, in which the hollow cathode means comprises a hollow tube.

19. A plasma switch as in claim 16, in which the hollow cathode means comprises two generally annular sections which are disposed coaxially about the axis of the hollow cathode means, and are radially spaced from each other to define an annular hollow space therebetween.

20. A plasma switch as in claim 16, in which the second voltage is positive relative to the hollow cathode means for the electrical connection between the hollow cathode means and the anode means.

21. An inverter/converter, comprising:

direct current power source means;

voltage transformer means having primary winding means connected in circuit with the power source means, and secondary winding means;

rectifier means connected in circuit with the secondary winding means; and at least one plasma switch connected in circuit to connect the power source means to the primary winding means in response to an applied electrical switching signal, each said plasma switch including:

an enclosure for containing an ionizable gas;

thermionic hollow cathode means, and anode means, disposed inside the enclosure;

the hollow cathode means axially discharging therefrom an ionized plasma of the gas;

the anode means being disposed to extract electrons from the plasma discharged from the hollow cathode means;

keeper electrode means disposed between the hollow cathode means and the anode means for sustaining plasma discharge of the gas between the hollow cathode means and the keeper electrode means in response to a first voltage applied to the keeper electrode means; and control electrode means disposed between the keeper electrode means and the anode means for causing the plasma to extend from the hollow cathode means to the anode means in response to the switching signal, whereby the voltage of the control electrode means is made positive relative to the hollow cathode means thereby electrically connecting the hollow cathode means and the anode means with a low forward voltage drop, the pressure of the ionizable gas being low enough to maintain voltage standoff between the control electrode and the anode means;

the hollow cathode means, anode means, keeper electrode means, and control electrode means being configured such that the plasma will extend from the hollow cathode means substantially only to the keeper electrode means when the switching signal applied to the control electrode makes the voltage of the control electrode non-positive relative to the cathode means, thereby interrupting the electrical connection between the anode means and the hollow cathode means thereby disconnecting the anode means from the hollow cathode means.

22. An inverter/converter as in claim 21, in which the switching signal is applied periodically, resulting in the hollow cathode means and anode means being alternately connected and interrupted at a frequency of the switching signal.

23. An inverter/converter as in claim 21, in which the power source means has first and second terminals, and the primary winding means has first and second ends and a center tap, the first terminal of the power source means being connected to the center tap of the primary winding means;

said at least one plasma switch comprising a first plasma switch connected between the second terminal of the power source means and the first end of the primary winding means; and a second plasma switch connected between the second terminal of the power source means and the second end of the primary winding means;

the switching signal being applied alternately to the first and second plasma switches.

24. An inverter/converter as in claim 21, in which the anode means of each plasma switch is disposed along the axis of the hollow cathode means.

25. An inverter/converter, comprising:

direct current power source means;

voltage transformer means having primary winding means connected in circuit with the power source means, and secondary winding means;

rectifier means connected in circuit with the secondary winding means; and at least one plasma switch connected in circuit to connect the power source means to the primary winding means in response to an applied electrical switching signal, each said plasma switch including:

an enclosure for containing an ionizable gas;

hollow cathode means, and anode means, disposed inside the enclosure;

the hollow cathode means axially discharging therefrom an ionized plasma of the gas;

the anode means being disposed to radially extract electrons from the plasma discharged from the hollow cathode means;

keeper electrode means disposed between the hollow cathode means and the anode means for sustaining plasma discharge of the gas between the hollow cathode means and the keeper electrode means in response to a first voltage applied to the keeper electrode means; and control electrode means disposed between the keeper electrode means and the anode means for causing the plasma to extend from the hollow cathode means to the anode means in response to a second voltage applied to the control electrode means which makes the control electrode positive relative to the hollow cathode means, thereby electrically connecting the hollow cathode means and anode means;

the hollow cathode means, anode means, keeper electrode means, and control electrode means being configured such that the plasma will extend from the hollow cathode means substantially only to the keeper electrode means when the second voltage on the control electrode is changed to make the control electrode non-positive relative to the hollow cathode means.

26. An inverter/converter as in claim 25, in which the keeper electrode means, control electrode means, and anode means of each plasma switch are generally annular, and are disposed coaxially about the axis of the hollow cathode means.

27. An inverter/converter as in claim 25, in which the hollow cathode means of each plasma switch comprises a hollow tube.

28. An inverter/converter as in claim 25, in which the hollow cathode means of each plasma switch comprises two generally annular sections which are disposed coaxially about the axis of the hollow cathode means, and are radially spaced from each other to define an annular hollow space therebetween.

* * * * *